US005889873A

United States Patent [19]

Sasaki

[11] Patent Number: 5,889,873

[45] Date of Patent: Mar. 30, 1999

[54] PIEZOELECTRIC ACOUSTIC TRANSDUCER

[75] Inventor: Yoshifumi Sasaki, Yuri-gun, Japan

[73] Assignee: TDK Corporation, Tokyo, Japan

[21] Appl. No.: 814,364

[22] Filed: Mar. 11, 1997

[30] Foreign Application Priority Data

Mar. 11, 1996 [JP] Japan ..... 8-053558
Feb. 7, 1997 [JP] Japan ..... 9-025657

[51] Int. Cl.[6] ..... H04R 25/00

[52] U.S. Cl. ..... 381/190; 381/191; 310/324

[58] Field of Search ..... 381/190, 410, 381/344, 114, 191; 310/324

[56] References Cited

U.S. PATENT DOCUMENTS 4,295,009 10/1981 Weidler ..... 381/190

FOREIGN PATENT DOCUMENTS 60-98795 6/1985 Japan .
64-13900 1/1989 Japan .
64-8899 1/1989 Japan .
2-38558 10/1990 Japan .
2-45917 12/1990 Japan .
64200 3/1991 Japan ..... 381/190
6-38399 5/1994 Japan .

*Primary Examiner*—Huyen Le
*Attorney, Agent, or Firm*—Oblon, Spivak, McClelland, Maier & Neustadt, P.C.

[57] ABSTRACT

A piezoelectric acoustic transducer that can be reliably and easily connected with an external conductor without detracting from the vibration characteristics of the piezoelectric acoustic transducing element is provided. A first case member is provided with an acoustic hole continuous with an internal space. A piezoelectric acoustic transducing element is constituted by mounting a piezoelectric element on one surface of a diaphragm and is housed inside the case partitioning the internal space into two portions. Ends of terminal members are connected to the piezoelectric element inside the case, their middle portions are held between the first case member and the second case member and the portions that are beyond the middle portions are led out to the outside of the case to constitute spring pieces, which are folded upward and back over the one surface of the second case member.

18 Claims, 9 Drawing Sheets

PIEZOELECTRIC ACOUSTIC TRANSDUCER

BACKGROUND OF THE INVENTION

1. Field of the Invention

The present invention relates to a piezoelectric acoustic transducer that may be employed in a buzzer, a telephone or the like.

2. Discussion of Background

When electrically connecting a piezoelectric acoustic transducer and an external conductor, a lead wire covered with an insulator is employed under normal circumstances, with one end of the lead wire soldered onto a piezoelectric acoustic transducing element included in the piezoelectric acoustic transducer and the other end led out to the outside of the piezoelectric acoustic transducer and soldered onto the external conductor. Such technology is disclosed in Japanese Examined Utility Model Publication No. 38558/1990, Japanese Unexamined Utility Model Publication No. 38399/1994, Japanese Unexamined Utility Model Publication No. 13900/1989, Japanese Unexamined Patent Publication No. 13800/1986, U.S. Pat. No. 4,006,371, U.S. Pat. No. 3,700,938 and the like.

As a means for dispensing with the complicated and time consuming process of soldering, Japanese Examined Utility Model Publication No. 45917/1990, Japanese Unexamined Patent Publication No. 199298/1985, U.S. Pat. No. 4,965,483 and the like disclose a technology in which a spring terminal member is employed that is electrically connected to a piezoelectric acoustic transducing element by its spring pressure, with a spring terminal led out to the outside of the piezoelectric acoustic transducer to be electrically connected to an external conductor.

However, when a spring terminal is to be employed, the following requirements must be satisfied. First, in the electrical connection between the spring terminal and the external conductor, a high degree of reliability must be assured for the connecting portion, i.e., the force with which they press against each other at the contact point portion must be great. Second, in the electrical connection with the piezoelectric acoustic transducing element, the spring terminal must not inhibit the vibration of the diaphragm, i.e., the force with which it is held against the piezoelectric acoustic transducing element at the contact point portion must not be greater than necessary.

Since these two requirements conflict with each other, it is difficult to satisfy them both and none of the prior art publications mentioned above discloses a means for satisfying these requirements.

SUMMARY OF THE INVENTION

It is an object of the present invention to provide a piezoelectric acoustic transducer that may be employed in a buzzer or a transmitter/receiver for a telephone.

It is a further object of the present invention to provide a piezoelectric acoustic transducer that can be electrically connected to an external conductor easily and reliably without requiring processes such as soldering.

It is a still further object of the present invention to provide a piezoelectric acoustic transducer that is capable of operating in a stable manner without detracting from the vibration characteristics of the piezoelectric acoustic transducing element.

It is a still further object of the present invention to provide a piezoelectric acoustic transducer with which an improvement in reliability of the electrical connection with an external conductor is achieved.

In order to achieve the objects described above, the piezoelectric acoustic transducer according to the present invention includes a case, a piezoelectric acoustic transducing element and at least one pair of terminal members. The case is constituted by combining a first case member and a second case member and has an internal space. The first case member is provided with an acoustic hole that is continuous with the internal space. The piezoelectric acoustic transducing element is constituted by mounting a piezoelectric element on one surface of a diaphragm and is housed inside the internal space of the case, partitioning the internal space into two portions.

Each of the pair of terminal members has one end connected to the piezoelectric acoustic transducing element inside the case, a middle portion held between the first case member and the second case member and a portion beyond the middle portion led out to the outside of the case constituting a spring piece which is bent upward and back over one surface of the second case member.

The piezoelectric acoustic transducing element is constituted by mounting a piezoelectric element on one surface of a diaphragm and is housed in the internal space of the case, partitioning the internal space of the case into two portions. The first case member is provided with an acoustic hole continuous with the internal space. In such a structure, it is possible to excite the piezoelectric acoustic transducing element with an electrical signal and to release a vibration sound to the outside via the acoustic hole (receiver function). In addition, it is possible to guide an acoustic wave into the inside of the first case member through the acoustic hole provided at the first case member, causing the piezoelectric acoustic transducing element to vibrate in conformance to the sound pressure and frequency and convert the vibration to an electrical signal with the piezoelectric effect provided by the piezoelectric element (transmitter function). This means that the piezoelectric acoustic transducer according to the present invention may be adopted in a buzzer and a transmitter/receiver for a telephone.

Since, in each of the pair of terminal members, the portion beyond the middle portion is led out to the outside of the case constituting a spring piece which is bent upward and back over one surface of the case, when adopting the present invention in a buzzer or a transmitter/receiver for a telephone, an external conductor can be electrically connected to the pair of terminal members by pressing the external conductor against the spring pieces from above the one surface of the case so that it is electrically connected to the spring pieces by taking advantage of the spring pressure generated at that point. Consequently, the pair of terminal members and the external conductor can be electrically connected with ease and a high degree of reliability without requiring processes such as soldering.

In each of the pair of terminal members, one end is connected inside the case to the piezoelectric acoustic transducing element and the middle portion is held between the first case member and the second case member. In this structure, the pressure applied by the external conductor to the spring pieces is cut off at the middle portion of the terminal members and is not, therefore, communicated to the ends that are connected to the piezoelectric acoustic transducing element. As a result, a piezoelectric acoustic transducer that is capable of operating in a stable manner without detracting from the vibration characteristics of the piezoelectric acoustic transducing element is achieved.

Furthermore, since the pressure applied by the external conductor to the spring pieces is cut off at the middle portions of the terminal members and is not, therefore, communicated to the end portions that are connected to the piezoelectric acoustic transducing element, the vibration characteristics of the piezoelectric acoustic transducing element is not adversely affected even when the reliability of the connection is improved by increasing the spring force, thereby increasing the contact pressure with the external conductor through means such as increasing the thickness of the spring pieces.

BRIEF DESCRIPTION OF THE DRAWINGS

More specific features and advantages of the present invention are explained in further detail in reference to the drawings, wherein.

DETAILED DESCRIPTION OF THE PREFERRED EMBODIMENTS

In reference to FIGS. 1 to 5, the piezoelectric acoustic transducer according to the present invention includes a case 1, a piezoelectric acoustic transducing element 2 and a pair of terminal members 31 and 32.

Figure 1:
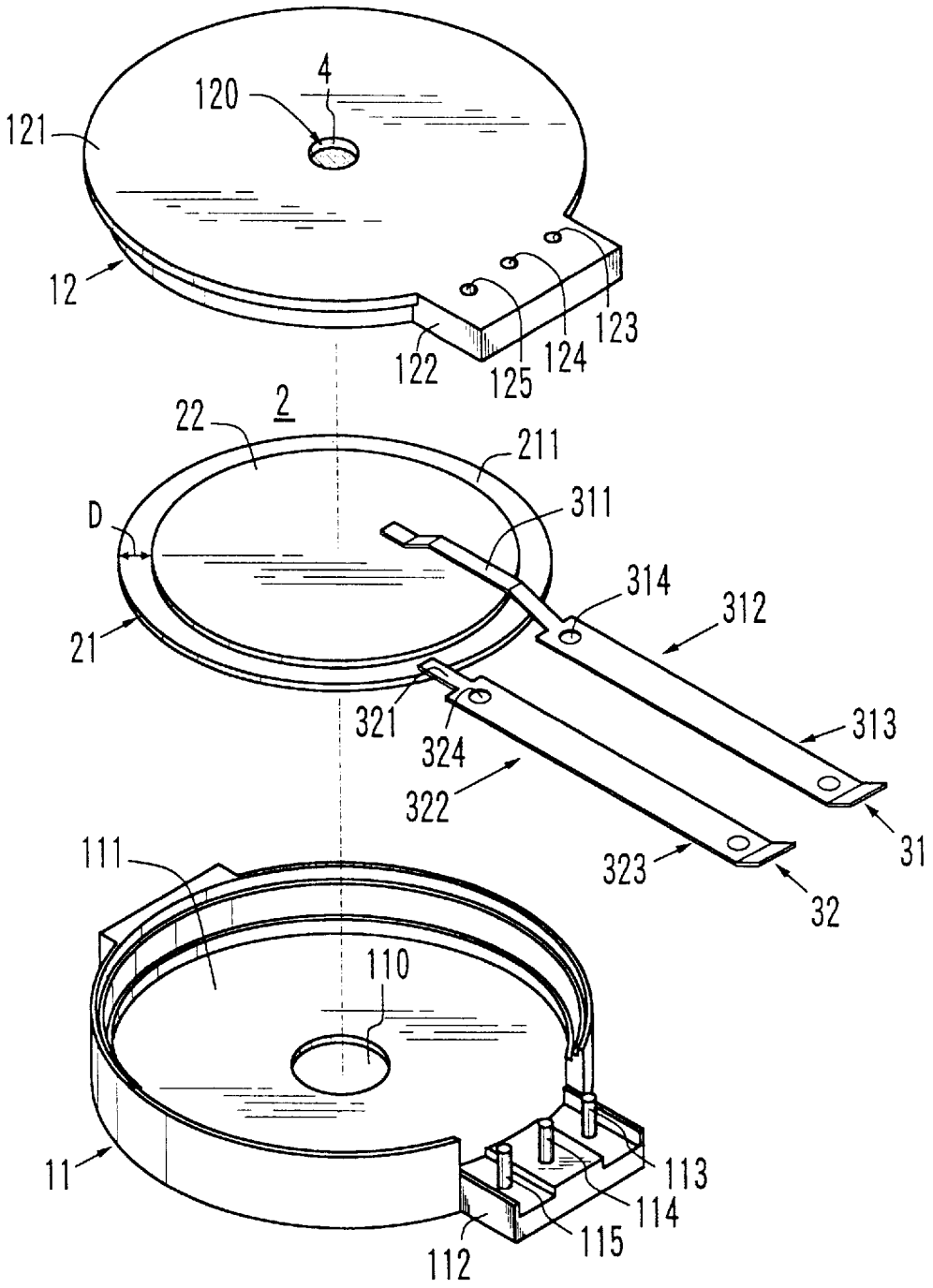
FIG. 1 is a perspective of the piezoelectric acoustic transducer according to the present invention in a disassembled state.
Figure 2:
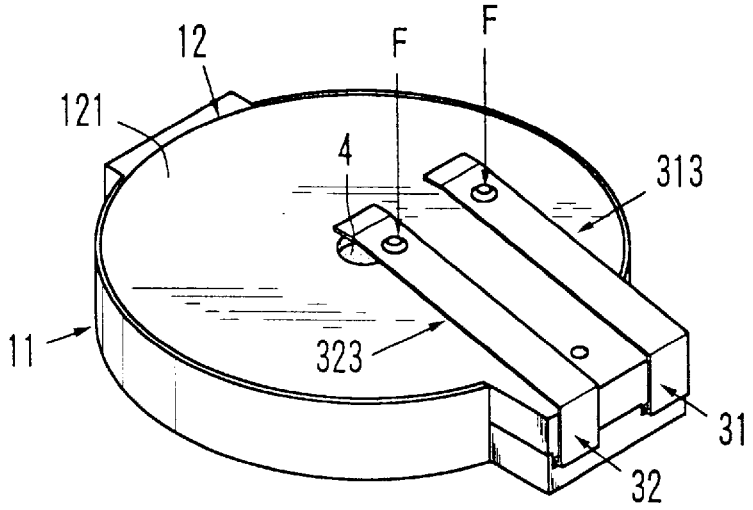
FIG. 2 is a perspective of the piezoelectric acoustic transducer shown in FIG. 1.
Figure 3:
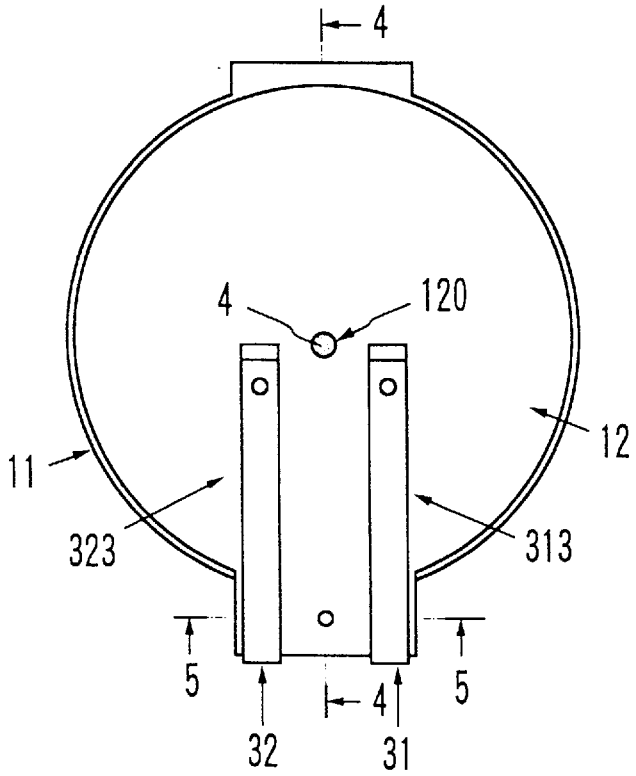
FIG. 3 is a plan view of the piezoelectric acoustic transducer shown in FIGS. 1 and 2.
Figure 4:
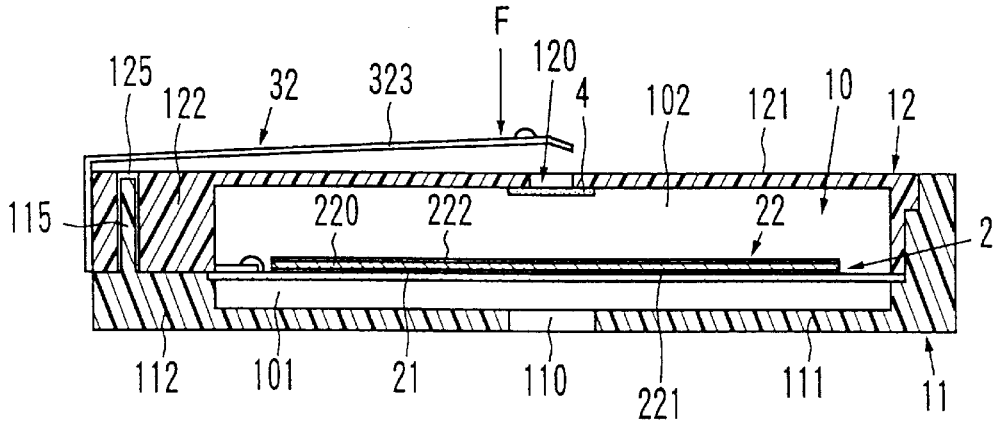
FIG. 4 is a cross section through line 4—4 in FIG. 3.
Figure 5:
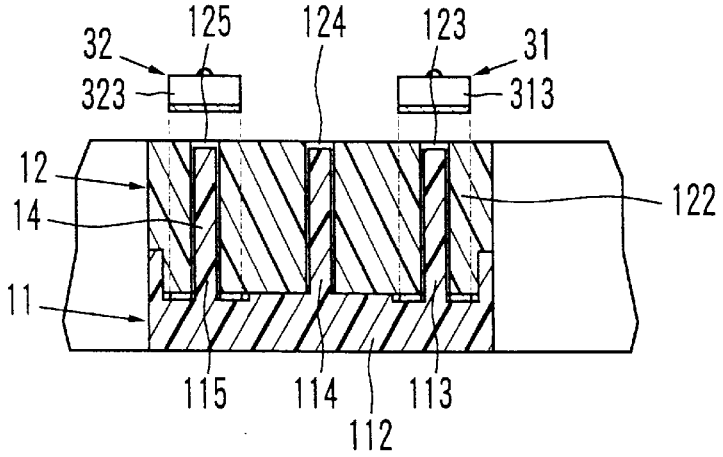
FIG. 5 is a cross section through line 5—5 in FIG. 3.

The case 1 is constituted by combining a first case member 11 and a second case member 12 and has an internal space 10 (see FIG. 4). The first case member 11 is provided with an acoustic hole 110 which is continuous with the internal space 10. The case 1 is constituted by using a resin with thermal plasticity such as polystyrene (ABS), polyethylene terephthalate (PBT), polycarbonate (PC) or the like. These materials are selected as appropriate to meet specific purposes of use. The case 1 is manufactured through injection molding or the like. Its shape may be set freely in correspondence to specific purposes of use. The first case member 11 and the second case member 12 in this embodiment both have a short cylindrical form and the case 1 is assembled by interlocking the side wall portions at the peripheral areas of the first case member 11 and the second case member 12 with each other.

The piezoelectric acoustic transducing element 2 is constituted by mounting a piezoelectric element 22 on one surface 211 of a diaphragm 21 and is housed inside the internal space 10 of the case 1 partitioning the internal space 10 into two portions. The piezoelectric element 22 is provided with electrodes 221 and 222 on two surfaces that face opposite each other of a piezoelectric ceramic 220 (see FIG. 4). These electrodes 221 and 222 are formed of Ag or the like by employing a vacuum deposition method or a printing method. The diaphragm 21 and the piezoelectric element 22 are bonded to each other with electrically conductive paste or the like and are electrically continuous with each other through the electrically conductive paste. In addition, in correspondence to individual purposes of use, the structure achieved by bonding one piezoelectric element 22 onto one surface of the diaphragm 21 (unimorph) or a structure achieved by bonding two piezoelectric elements, each onto either surface of the diaphragm 21 (bimorph) may be adopted. There are no restrictions imposed upon the materials, the manufacturing methods or the shapes of the diaphragm 21 and the piezoelectric element 22 and they may be selected as appropriate to meet specific purposes of use. As a material to constitute the diaphragm 21, brass or the like may be used, for instance, and the material for constituting the piezoelectric element 22 may be, for instance, a PMN-group material, a PZT-group material or the like.

In the terminal member 31, one end 311 is connected to the piezoelectric element 22 inside the case 1, the middle portion 312 is held between the first case member 11 and the second case member 12 and a portion that is beyond the middle portion 312 is led out to the outside of the case 1 constituting a spring piece 313 which is bent upward and back over one surface of the second case member 12. The connection between the one end 311 and the piezoelectric element 22 may be achieved by a means for securing such as soldering, or a structure in which a spring force is created at the one end 311 so that it can be placed in contact with the surface of the piezoelectric element 22 in a flexible manner may be adopted.

In the terminal member 32, one end 321 is connected to the diaphragm 21 inside the case 1, a middle portion 322 is held between the first case member 11 and the second case member 12 and a portion that is beyond the middle portion 322 is led out to the outside of the case 1 constituting a spring piece 323 which is bent upward and back over one surface of the second case member 12. The connection between the one end 321 and the diaphragm 21 may be achieved by a means for securing such as soldering, or a structure in which a spring force is created at one end 321 so that it can be placed in contact with the surface of the piezoelectric element 21 in a flexible manner may be adopted. The terminal members 31 and 32 are constituted of a material such as phosphor bronze plate, beryllium copper plate, stainless steel plate or the like.

As explained above, the piezoelectric acoustic transducing element 2 is constituted by mounting the piezoelectric element 22 on one surface of the diaphragm 21 and is housed inside the internal space 10 of the case 1 partitioning the internal space 10 of the case 1 into two portions. The first case member 11 is provided with the acoustic hole 110 that is continuous with the internal space 10. In such a structure, an acoustic wave can be led into the first case member 11 through the acoustic hole 110 provided at the first case member 11 to cause the piezoelectric acoustic transducing element 2 to vibrate in conformance to the sound pressure and frequency and this vibration can be converted to an electrical signal with the piezoelectric effect imparted by the piezoelectric element 22. In addition, it is possible to excite the piezoelectric acoustic transducing element 2 with an electrical signal so that a vibrating sound is released to the outside through the acoustic hole 110. This means that the piezoelectric acoustic transducer according to the present invention can be adopted in a buzzer and a transmitter/receiver for a telephone.

The portions of the pair of terminal members 31 and 32 which are beyond the middle portions 312 and 322 are led out to the outside of the case 1, constituting the spring pieces 313 and 323 that are bent upward and back over the one surface 121 of the second case member 12. Thus, when electrically connecting an external conductor to the pair of terminal members 31 and 32 in an application to a buzzer, a transmitter/receiver for a telephone, the external conductor can be electrically connected to the spring pieces 313 and 323 by pressing it against the spring pieces 313 and 323 from above the one surface 121 of the second case member 12 in the direction indicated with the arrow F (see FIG. 2) and by taking advantage of the spring pressure that is generated at that point. As a result, the pair of terminal members 31 and 32 and the external conductor can be electrically connected easily, reliably and without requiring processes such as soldering.

In the terminal member 31, the one end 311 is connected to the piezoelectric element 22 inside the case 1, and the middle portion 312 is held between the first case member 11 and the second case member 12. In the terminal member 32, the one end 321 is connected inside the case 1 to the diaphragm 21 and the middle portion 322 is held between the first case member 11 and the second case member 12. In such a structure, the pressure F applied by the external conductor to the spring pieces 313 and 323 is cut off at the middle portions 312 and 322 of the terminal members 31 and 32 respectively and is not communicated to the end portions 311 and 321, which are connected to the piezoelectric acoustic transducing element 2. Because of this, a piezoelectric acoustic transducer that is capable of operating in a stable manner without detracting from the vibration characteristics of the piezoelectric acoustic transducing element 2 is achieved.

Moreover, since the pressure F applied by the external conductor to the spring pieces 313 and 323 is cut off at the middle portion 312 an 322 of the terminal members 31 and 32 respectively and is not communicated to either of the end portions 311 and 321 that are connected to the piezoelectric acoustic transducing element 2, the vibration characteristics of the piezoelectric acoustic transducing element 2 are not adversely affected at all, even when the contact pressure with the external conductor is increased through an increase in the spring force which may be achieved by increasing the width of the spring pieces 313 and 323 to achieve an improvement in the reliability of the connection.

The combination of the pair of terminal members 31 and 32 and the external conductor will be explained in detail in reference to a specific example in which the piezoelectric acoustic transducer according to the present invention is adopted in a transmitter/receiver for a telephone.

In reference to FIG. 4 in particular, among FIGS. 1 to 5, the first case member 11 creates a first acoustic space 101 formed at the front surface of the piezoelectric acoustic transducing element 2 and the second case member 12 creates a second acoustic space 102 which is partitioned from the first acoustic space 101 and is formed at the rear surface of the piezoelectric acoustic transducing element 2. In this structure, acoustic characteristics which take advantage of the resonance characteristics of the first acoustic space 101 and the second acoustic space 102 can be achieved.

The second case member 12 is provided with a rear air hole 120 that is continuous with the second acoustic space 102 and the rear air hole 120 is closed off by an acoustic resistance sheet 4. In this structure, an appropriate degree of acoustic resistance damping is provided by the rear air hole 120 and the acoustic resistance sheet 4 to flatten the frequency characteristics, achieving an improvement in the frequency characteristics.

Furthermore, the second case member 12 is provided with a rear surface portion 121 which faces opposite a ceiling surface portion 111 of the first case member 11. The terminal members 31 and 32 are bent upward and back over the rear surface portion 121 of the second case member 12. In an application to a buzzer or a telephone, this structure facilitates assembly, since the external conductor can be placed in spring contact from the side where the rear surface portion 121 of the second case member 12 is provided which is on the opposite side from the ceiling surface portion 111 of the first case member 11, with the side where the ceiling surface portion 111 of the first case member 11 is provided used as an acoustic response surface.

Moreover, in the terminal members 31 and 32, the thickness of the portions that are led out to the outside of the case 1 is greater than the thickness at the end portions 311 and 321. This structure makes it possible to adjust the strength of the terminal members 31 and 32 at the end portions 311 and 321 and at the portions that are led out to the outside of the case 1. Toward the ends 311 and 321 of the terminal members 31 and 32, the terminal member strength is reduced to ensure that the vibration of the piezoelectric element 22 is not inhibited, whereas at the portions that are led out to the outside of the case 1, the terminal member strength is increased to ensure that the electrical connection with the outside is achieved reliably. In order to achieve the terminal member strength described above, the terminal members 31 and 32 are required to have a thickness of 0.15 to 0.4 mm at the portions that are led out to the outside of the case 1 and a thickness of 0.03 to 0.13 mm toward the end portions 311 and 321. The terminal member strength in this context refers to the force required to deform the terminal members.

Figure 6:
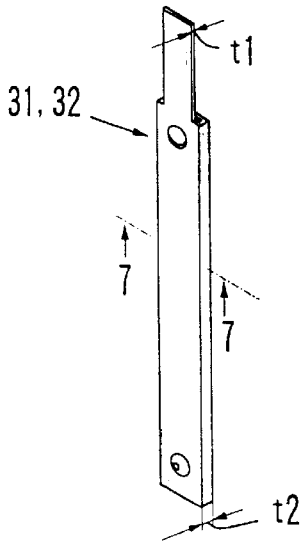
FIG. 6 is a perspective showing an example of a terminal member employed in the piezoelectric acoustic transducer shown in FIGS. 1 to 5.
Figure 7:
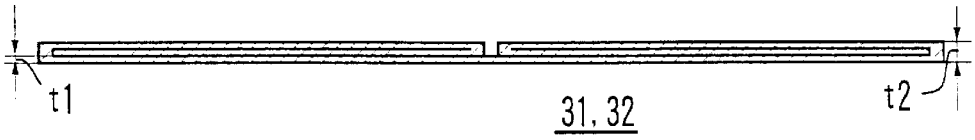
FIG. 7 is an enlarged cross section through line 7—7 in FIG. 6.

The terminal members 31 and 32 with the thicknesses specified above, can be obtained easily by folding metal plate material. FIGS. 6 to 13 show specific examples of the terminal members 31 and 32 which are achieved as folded parts manufactured by folding metal plate material and also show a method for manufacturing them. In the figures, the dimensions do not always correspond to those in the embodiment shown in FIGS. 1 to 5. FIG. 6 is a perspective of the terminal members 31 and 32 and FIG. 7 is an enlarged cross section through line 7—7 in FIG. 6.

In reference to FIGS. 6 and 7, each of the end portions 311 and 321 of the terminal members 31 and 32 respectively has a thickness t1 which is constituted of the plate thickness of the metal plate material. The thickness in areas other than the end portions 311 and 321 is increased to a thickness t2 through folding the metal plate material. By adopting such a structure, terminal members with the thickness t1 of the end portions 311 and 321 which are connected to the piezoelectric acoustic transducing element 2 minimized to ensure that the vibration characteristics of the piezoelectric acoustic transducing element 2 are not adversely affected and the thickness t2 of the spring pieces 311 and 312 which come in contact with the external conductor increased to improve the spring strength and provide an increase in contact pressure in the electrical connection with the external conductor, can be achieved easily.

Figure 8:
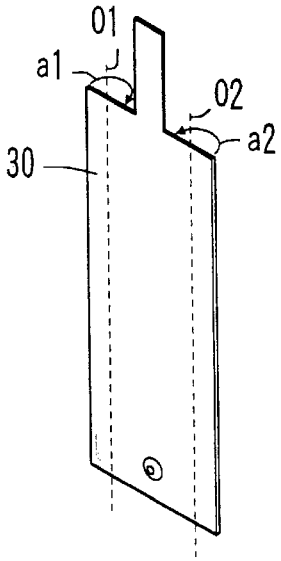
FIG. 8 is a perspective showing a manufacturing process of the terminal member shown in FIGS. 6 and 7.
Figure 9:
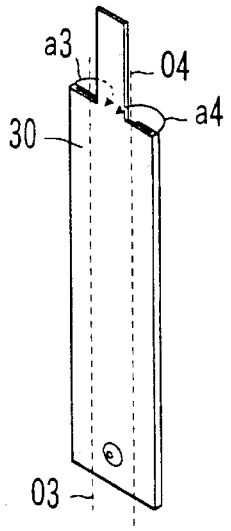
FIG. 9 is a perspective showing a process following the manufacturing process shown in FIG. 8.

FIGS. 8 and 9 illustrate a method for manufacturing the terminal members shown in FIGS. 6 and 7. As shown in FIG. 8, a metal plate material 30 is folded in the directions indicated with the arrows a1 and a2 along the dotted lines 01 and 02.

Next, as shown in FIG. 9, the metal plate material 30 is folded in the directions indicated with the arrows a3 and a4 along the dotted lines 03 and 04. Thus, the terminal members 31 and 32 shown in FIGS. 6 and 7 are achieved.

Figure 10:
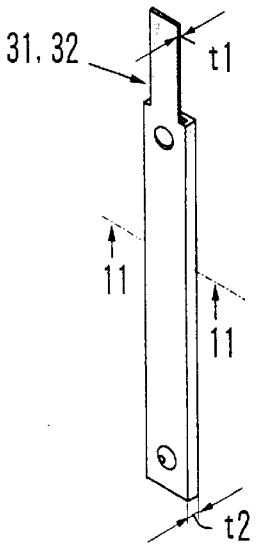
FIG. 10 is a perspective showing another example of a terminal member employed in the piezoelectric acoustic transducer shown in FIGS. 1 to 5.
Figure 11:
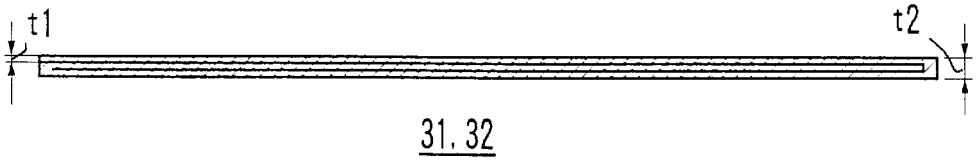
FIG. 11 is an enlarged cross section through line 11—11 in FIG. 10.

FIG. 10 is a perspective showing another embodiment of the terminal members 31 and 32 and FIG. 11 is an enlarged cross section through line 11—11 in FIG. 10. In these figures, the dimensions do not always correspond to those in the embodiment shown in FIGS. 1 to 5.

In FIGS. 10 and 11, each of the end portions 311 and 321 of the terminal members 31 and 32 respectively has a thickness t1 which is constituted of the plate thickness of the metal plate material. The thickness in the areas other than the end portions 311 and 312 is increased to a thickness t2 through folding the metal plate material. Consequently, the terminal members 31 and 32 shown in FIGS. 10 and 11 also achieve advantages similar to those achieved in the embodiment shown in FIGS. 6 and 7.

Figure 12:
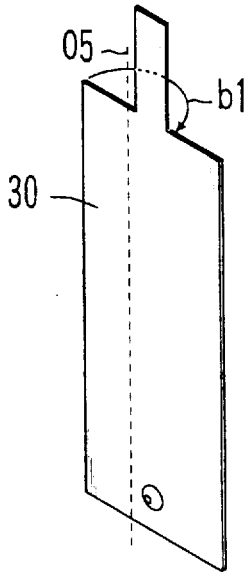
FIG. 12 is a perspective showing a manufacturing process for the terminal member shown in FIGS. 10 and 11.
Figure 13:
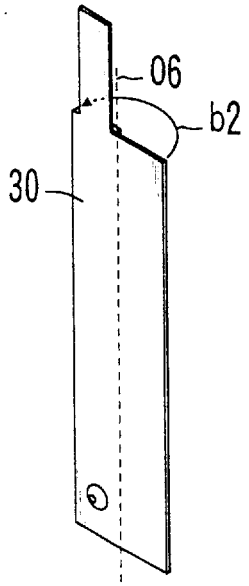
FIG. 13 is a perspective showing a process following the manufacturing process shown in FIG. 12.

FIGS. 12 and 13 illustrate another method for manufacturing the terminal members 31 and 32 shown in FIGS. 10 and 11. First, as shown in FIG. 12, the metal plate material 30 is folded in the direction indicated with the arrow b1 along the dotted line 05.

Then, as shown in FIG. 13, the metal plate material 30 is folded in the direction indicated with the arrow b2 along the dotted line 06. Thus, the terminal members 31 and 32 shown in FIGS. 10 and 11 are achieved.

Now, an explanation is given in reference to FIGS. 1 to 5 again. The front end portions of the spring pieces 313 and 323 are positioned above the one surface 121 of the second case member 12. This structure ensures that in an application such as a buzzer or a telephone, the external conductor can be placed in contact with the spring pieces 313 and 323 with a high degree of reliability and that the piezoelectric acoustic transducer can be fixed in a stable manner.

Furthermore, in the first case member 11, a terminal lead-out portion 112, which holds the middle portion 312 of the terminal member 31, constitutes a projecting portion which projects out to the outside. In the second case member 12, a terminal lead-out portion 122, which holds the middle portion 322 of the terminal member 32, constitutes a projecting portion which projects out to the outside. In this structure, since the areas over which the middle portions 312 and 322 of the terminal members 31 and 32 are held are increased, the pressure applied by the external conductor to the spring pieces 313 and 323 is cut off more reliably and the terminal members 31 and 32 are secured with a higher degree of reliability.

Moreover, the first case member 11 is provided with projections 113, 114 and 115 at the terminal lead-out portion 112 and the second case member is provided with holes 123, 124 and 125 at the terminal lead-out portion 122 into which the projections 113, 114 and 115 fit. This structure, in which the projections 113, 114 and 115 are fitted into the holes 123, 124 and 125 respectively, ensures that the first case member 11 and the second case member 12 are fitted together with a high degree of reliability.

The projection 113 and the hole 123 are positioned within an area through which the terminal member 31 passes. The projection 115 and the hole 125 are positioned within an area through which the terminal member 32 passes. The terminal member 31 is provided with a hole 314, through which the projection 113 is made to pass at the middle portion 312. The terminal member 32 is provided with a hole 324, through which the projection 115 is made to pass at the middle portion 322. This structure allows the terminal members 31 and 32 to be reliably positioned and secured in the case 1, with the projection 113 passing inside the hole 314 of the terminal member 31 and the projection 115 passing inside the hole 324 of the terminal member 32. Thus, it becomes possible to prevent vibrational obstruction at the piezoelectric acoustic transducing element 2 caused by the shifting of positions of the terminal members 31 and 32.

The piezoelectric element 22 is mounted on the one surface 211 of the diaphragm 21 with a distance D maintained between its entire circumferential edge and the entire circumferential edge of the diaphragm 21. The circumferential portion of the diaphragm 21 is held between the first case member 11 and the second case member 12. This structure allows for the acoustic characteristics of the piezoelectric acoustic transducing element 2 to be easily set by setting a specific diameter, thickness and the like of the diaphragm 21.

Figure 14:
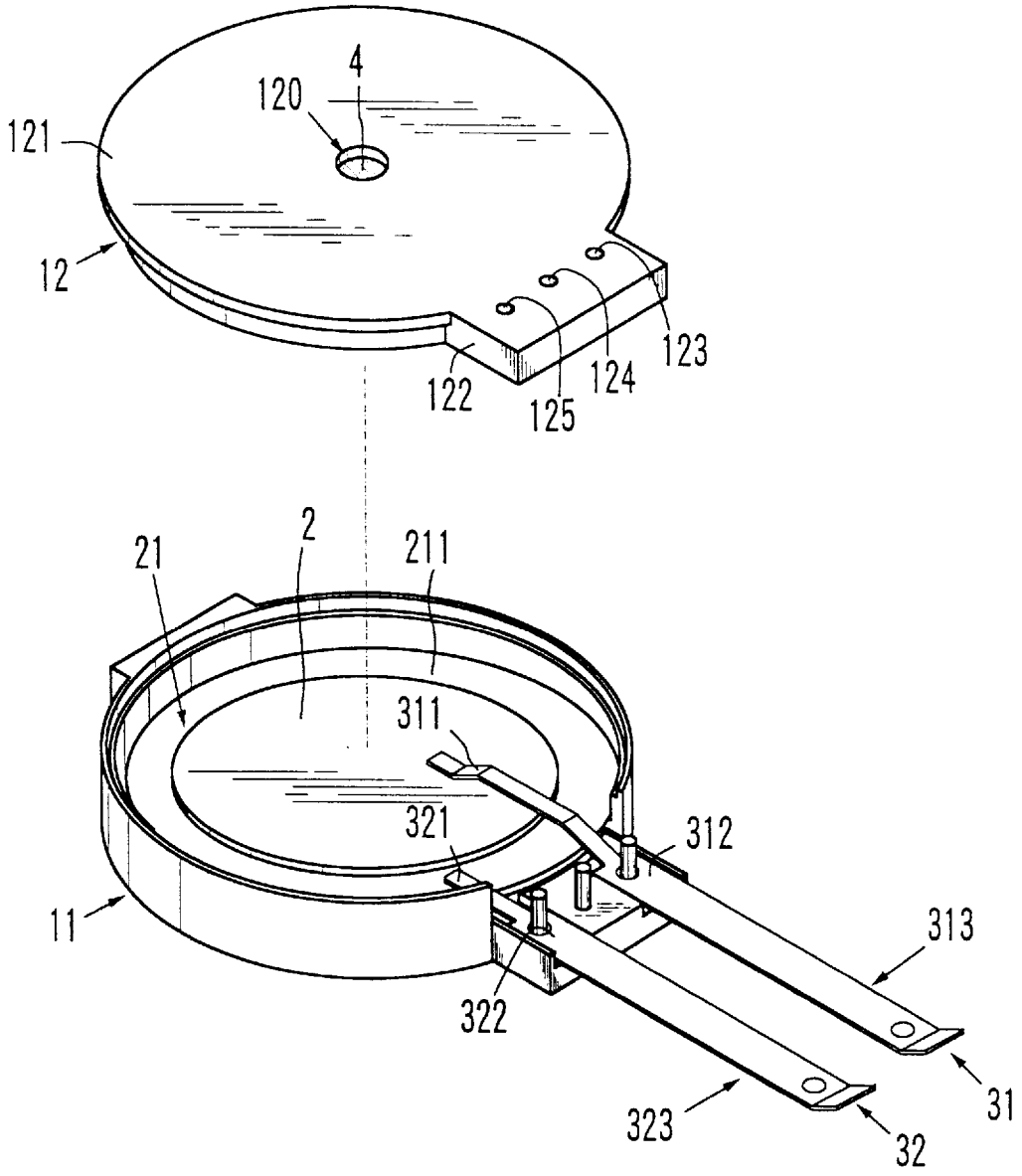
FIG. 14 is a perspective showing an assembly process performed for the piezoelectric acoustic transducer shown in FIGS. 1 to 5.
Figure 15:
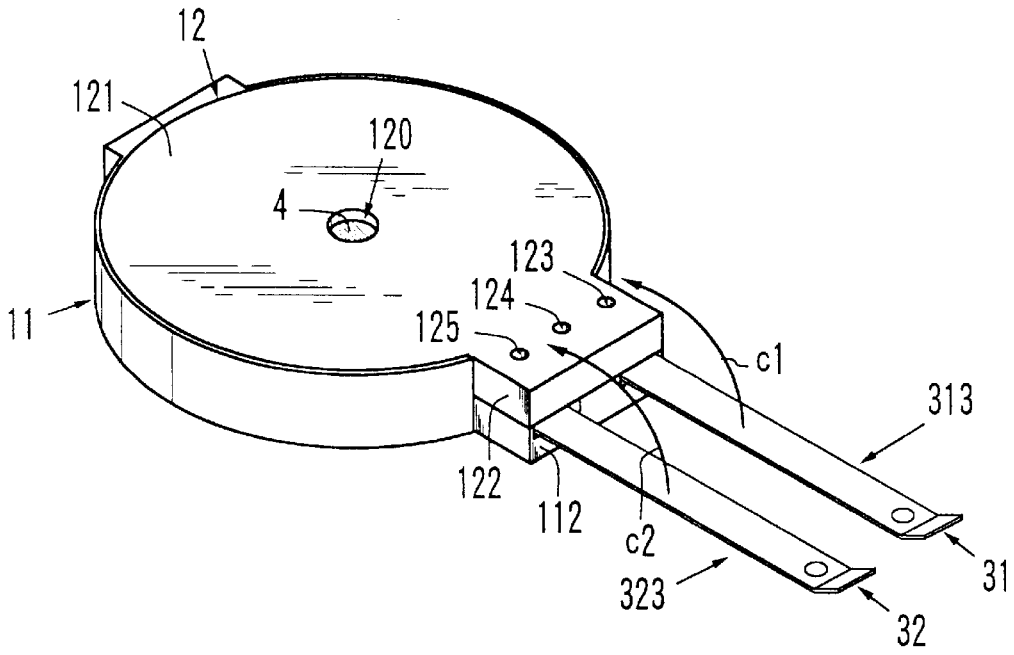
FIG. 15 is a perspective showing a process following the assembly process shown in FIG. 14.

FIGS. 14 and 15 illustrate the method for assembling the piezoelectric acoustic transducer according to the present invention. First, as shown in FIG. 14, the piezoelectric acoustic transducing element 2 is placed inside the first case member 11 and the terminal members 31 and 32 are connected with the piezoelectric acoustic transducing element 2.

Next, as shown in FIG. 15, the second case member 12 is fitted with the first case member 11, and the portions of the terminal members 31 and 32 that are led out to the outside of the case 1 are folded upward and back over the one surface 121 of the second case member 12 in the directions indicated with the arrows c1 and c2.

Figure 16:
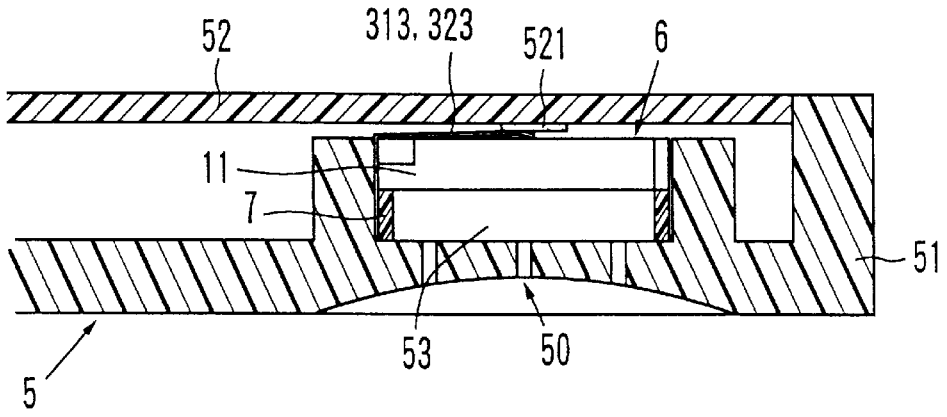
FIG. 16 is a partial cross section of a transmitter/receiver for a telephone employing the piezoelectric acoustic transducer according to the present invention.

The piezoelectric acoustic transducer according to the present invention may be adopted in a buzzer or a transmitter/receiver for a telephone. FIG. 16 shows a partial cross section of a transmitter/receiver for a telephone which employs the piezoelectric acoustic transducer according to the present invention and FIG. 17 shows the transmitter/receiver for a telephone shown in FIG. 16 in a disassembled state.

Figure 17:
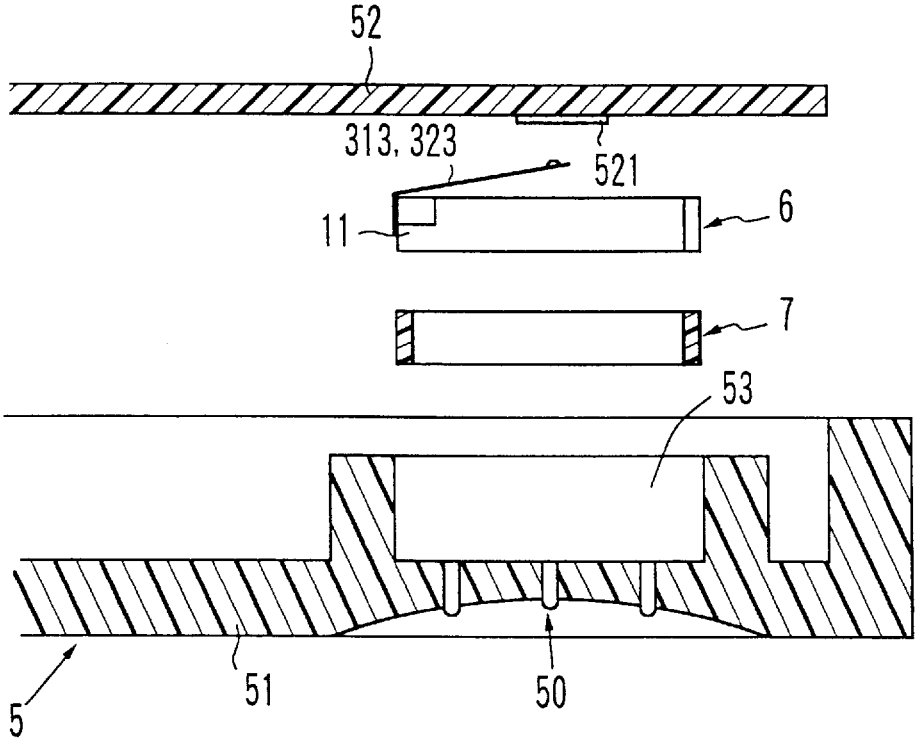
FIG. 17 is a diagram of the transmitter/receiver for a telephone shown in FIG. 16 in a disassembled state.

As shown in FIGS. 16 and 17, the transmitter/receiver for a telephone includes a transmitter/receiver main body 5 and a piezoelectric acoustic transducer 6. The piezoelectric acoustic transducer 6 is the piezoelectric acoustic transducer according to the present invention disclosed in the embodiments shown in FIGS. 1 to 15 and is provided inside the transmitter/receiver main body 5. The transmitter/receiver main unit 5 is provided with a mouthpiece and an earpiece 50. The piezoelectric acoustic transducer 6 is provided at either one of or both the mouthpiece and the earpiece 50.

Normally, a packing 7 is provided between the mouthpiece or earpiece 50 and the piezoelectric acoustic transducer 6. The packing 7 is constituted of an elastic body such as silicone rubber and is inserted in an indented portion 53 provided at the transmitter/receiver main unit 5 to prevent sound from leaking and degradation of the sound quality.

In the piezoelectric acoustic transducer 6, the acoustic hole 110 (see FIG. 1) provided at the first case member 11 is positioned so that it faces opposite the earpiece 50.

The transmitter/receiver main unit 5 is provided with a case 51 and a lid 52. The case 51, in turn, is provided with the mouthpiece or the earpiece 50. The lid 52 is provided at the rear surface of the case 51 on the opposite side from the side where the mouthpiece or the earpiece 50 is provided, and comes in contact with the spring pieces 313 and 323 of the terminal members 31 and 32 provided at the piezoelectric acoustic transducer 6 to press down on them. The lid 52 is provided with a pair of conductive patterns 521, which constitute an external conductor, in an area that comes in contact with the spring pieces 313 and 323 of the terminal members 31 and 32 respectively.

As has been explained in reference to FIGS. 1 to 5, in the piezoelectric acoustic transducer 6, the portions beyond the middle portions 312 and 322 of the terminal members 31 and 32 are led out to the outside of the case 1 to constitute the spring pieces 313 and 323 folded upward and back over the one surface 121 of the second case member 12. Thus, when electrically connecting the spring pieces 313 and 323 of the pair of terminal members 31 and 32 with the conductive patterns 521 at the lid 52, the conductive patterns 521 can be electrically connected to the spring pieces 313 and 323 by pressing them against the spring pieces 313 and 323 from above the one surface 121 of the second case member 12, taking advantage of the spring pressure that is generated when they are held against the spring pieces. As a result, the pair of terminal members 31 and 32 and the conductive patterns 521 provided at the lid 52 can be electrically connected with a high degree of reliability and ease without requiring processes such as soldering.

The one end 311 of the terminal member 31 is connected inside of the case 1 to the piezoelectric element 22 and its middle portion 312 is held between the first case member 11 and the second case member 12. The one end 321 of the terminal member 32 is connected inside the case 1 to the diaphragm 21 and its middle portion 322 is held between the first case member 11 and the second case member 12. In this structure, the pressure applied by the conductive patterns 521 to the spring pieces 313 and 323 is cut off at the middle portions 312 and 322 of the terminal members 31 and 32 and are not communicated to the end portions 311 and 321 that are connected to the piezoelectric acoustic transducing element 2. Consequently, a transmitter/receiver for a telephone capable of operating in a stable manner is achieved without detracting from the vibration characteristics of the piezoelectric acoustic transducing element 2.

Furthermore, since the pressure applied by the conductive patterns 521 to the spring pieces 313 and 323 is cut off at the middle portions 312 and 322 of the terminal members 31 and 32 is not communicated to the end portions 311 and 321 connected to the piezoelectric acoustic transducing element 2, the vibration characteristics of the piezoelectric acoustic transducing element 2 are not adversely affected even when the contact pressure with the conductive patterns 521 is increased through an increase in the spring force achieved by increasing the thickness of the spring pieces 313 and 323 to improve the reliability of the connection.

As has been explained, according to the present invention, the following advantages are achieved.

(a) A piezoelectric acoustic transducer which may be adopted in a buzzer or a transmitter/receiver for a telephone is provided.

(b) A piezoelectric acoustic transducer to which an external conductor can be electrically connected with a high degree of reliability and ease without requiring processes such as soldering is provided.

(c) A piezoelectric acoustic transducer capable of operating in a stable manner without detracting from the vibration characteristics of the piezoelectric acoustic transducing element is provided.

(d) A piezoelectric acoustic transducer with which the reliability of the electrical connection with an external conductor is improved is provided.

What is claimed is:

1. A piezoelectric acoustic transducer, comprising:

a case including a first case member, a second case member, and an internal space, said first case member including an acoustic hole continuous with said internal space;

a piezoelectric acoustic transducing element including a piezoelectric element on one surface of a diaphragm and housed inside said internal space of said case, partitioning said internal space into two portions; and at least one pair of terminal members, each terminal member of said at least one pair of terminal members having one end connected in said case to said piezoelectric acoustic transducing element, a middle portion held between said first case member and said second case member, and a portion beyond said middle portion extending out to an outside of said case, said portion being a spring piece extending upward and back over said second case member.

2. A piezoelectric acoustic transducer according to claim 1, wherein:

a peripheral portion of said diaphragm in said piezoelectric acoustic transducing element is supported by said case.

3. A piezoelectric acoustic transducer according to claim 1, wherein:

said first case member comprises a first acoustic space continuous with said acoustic hole in a front surface of said piezoelectric acoustic transducing element; and said second case member comprises a second acoustic space which is partitioned from said first acoustic space, at a rear surface of said piezoelectric acoustic transducing element.

4. A piezoelectric acoustic transducer according to claim 3, wherein:

said second case member comprises a rear air hole continuous said second acoustic space, with said rear air hole being closed off by an acoustic resistance sheet.

5. A piezoelectric acoustic transducer according to claim 4, wherein:

said first case member comprises a ceiling surface portion having said acoustic hole; and said second case member comprises a rear surface portion which has said rear air hole and which faces opposite said ceiling surface portion of said first case member.

6. A piezoelectric acoustic transducer according to claim 5, wherein:

said each terminal member extends back and upward relative to said rear surface portion of said second case member.

7. A piezoelectric acoustic transducer according to claim 1, wherein:

in said each terminal member, a thickness of said portion extending out the outside of said case is greater than a thickness of said one end connected in said case.

8. A piezoelectric acoustic transducer according to claim 7, wherein:

said each terminal member comprises a metal plate material;

said thickness of said one end connected in said case comprises a plate thickness of said metal plate material; and areas other than said one end connected in said case have a greater thickness, formed by folding said metal plate material, than said thickness of said one end connected is said case.

9. A piezoelectric acoustic transducer according to claim 1, wherein:

a front end portion of said spring pieces extend above a surface of said case.

10. A piezoelectric acoustic transducer according to claim 1, wherein:

terminal lead-out portions of said first case member and said second case member, which hold said middle portion of said each terminal member, comprise outward projecting portions.

11. A piezoelectric acoustic transducer according to claim 1, wherein:

one of said first case member or said second case member comprises projections at a terminal lead-out portion thereof and the other case member comprises holes to receive said projections at said terminal lead-out portion for holding said middle portion of said each terminal member.

12. A piezoelectric acoustic transducer according to claim 11, wherein:

two or more of both said projections and said holes are within an area through which said each terminal member passes; and said each terminal member comprises a hole through which one of said projections passes at said middle portion thereof.

13. A piezoelectric acoustic transducer according to claim 1, wherein:

said piezoelectric element on said one surface of said diaphragm includes a fixed distance between an entire circumference thereof and an entire circumference of said diaphragm; and a circumferential edge portion of said diaphragm including said fixed distance is held between said first case member and said second case member.

14. A transmitter/receiver for a telephone, comprising:

a receiver main unit; and a piezoelectric acoustic transducer including:

a case including a first case member, a second case member, and an internal space, said first case member including an acoustic hole continuous with said internal space;

a piezoelectric acoustic transducing element including a piezoelectric element on one surface of a diaphragm and housed inside said internal space of said case, partitioning said internal space into two portions; and at least one pair of terminal members, each terminal member of said at least one pair of terminal members having one end connected in said case to said piezoelectric acoustic transducing element, a middle portion held between said first case member and said second case member, and a portion beyond said middle portion extending out to an outside of said case, said portion being a spring piece extending upward and back over said second case member, said piezoelectric acoustic transducer being disposed inside said receiver main unit.

15. A transmitter/receiver according to claim 14, wherein:

said receiver main unit includes a mouthpiece and an earpiece; and said piezoelectric acoustic transducer is disposed at either said mouthpiece or said earpiece.

16. A transmitter/receiver according to claim 15, wherein:

said piezoelectric acoustic transducer is positioned so that said acoustic hole provided at said first case member faces opposite said mouthpiece or said earpiece.

17. A transmitter/receiver according to claim 16, wherein:

said receiver main unit includes a case and a lid;

said case includes said mouthpiece and said earpiece; and said lid is disposed at a rear surface of said case positioned on a side opposite from said mouthpiece and said earpiece and contacts and presses against said spring piece of said each terminal member.

18. A transmitter/receiver according to claim 17, wherein:

said lid comprises conductive patterns in an area contacting said spring piece of said each terminal member.

* * * * *